US008007239B2

(12) United States Patent
Hwang et al.

(10) Patent No.: US 8,007,239 B2
(45) Date of Patent: Aug. 30, 2011

(54) COOLING FAN HAVING PROTRUSION AT AIR OUTLET THEREOF

(75) Inventors: Ching-Bai Hwang, Taipei Hsien (TW); Ran Lin, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 929 days.

(21) Appl. No.: 11/955,319

(22) Filed: Dec. 12, 2007

(65) Prior Publication Data

US 2009/0129921 A1 May 21, 2009

(30) Foreign Application Priority Data

Nov. 16, 2007 (CN) ..... 2007 1 0124552

(51) Int. Cl.
*F04D 29/40* (2006.01)

(52) U.S. Cl. ..... 416/184; 416/204 R; 416/205; 416/206; 416/224

(58) Field of Classification Search ..... 416/184, 416/204, 205, 206, 224, 204 R
See application file for complete search history.

(56) References Cited

U.S. PATENT DOCUMENTS

| | | | | |
|---|---|---|---|---|
| 3,687,360 | A * | 8/1972 | Prew et al. | 494/85 |
| 5,997,246 | A * | 12/1999 | Humbad | 415/119 |
| 6,049,455 | A * | 4/2000 | Nakamura et al. | 361/688 |
| 6,805,536 | B2 * | 10/2004 | Hung | 416/244 R |
| 7,481,617 | B2 * | 1/2009 | Hsu et al. | 415/184 |

* cited by examiner

*Primary Examiner* — Igor Kershteyn
(74) *Attorney, Agent, or Firm* — Altis Law Group, Inc.

(57) ABSTRACT

A cooling fan (20) includes a housing (22) and an impeller (24). The housing has a base (221), a sidewall (222) extending from a periphery of the base with an air outlet (226) defined therein, and a cap (223) covering the sidewall. The impeller has a plurality of blades (242) rotatably received in the housing for generating an airflow. An air channel (225) is formed between tip portions of the blades and an inner face of the sidewall. The air outlet has a near section (226A) and a far section (226C). The airflow first reaches the near section and then the far section. The base of the housing has a protrusion (227) extending into the air outlet for guiding the airflow flowing towards the far section from the near section of the air outlet.

17 Claims, 4 Drawing Sheets

COOLING FAN HAVING PROTRUSION AT AIR OUTLET THEREOF

BACKGROUND OF THE INVENTION

1. Field of the Invention

The present invention relates generally to a cooling fan, and more particularly relates to a cooling fan having low noise and having more optimized airflow distribution.

2. Description of Related Art

The computer CPU speed has been greatly increased in recent years due to a rapid progress in semi-conductor technologies. The chip surface heat flux is thus higher and higher accordingly. It is becoming a critical challenge on how to remove the heat so that the system can run reliably. The compact space with high flow resistance in a notebook computer environment is even more critical in the heat removal. A cooling fan with higher air pressure is frequently chosen under such a consideration.

A cooling fan 10 in related art is shown in FIGS. 3-4. The cooling fan 10 includes a housing 12 and an impeller 14 disposed in the housing 12. The housing 12 includes a planar base 121, a sidewall 122 perpendicularly and upwardly extending from the base 121 and a cap 123 covering the sidewall 122. The impeller 14 includes a hub 141 and a plurality of blades 142 radially and outwardly extending from the hub 141. An air channel 16 is formed between tip portions of the blades 142 and an inner surface of the sidewall 122. In operation of the cooling fan 10, the blades 142 rotate in the housing 12 to impel intake airflow to flow towards a near section A of an air outlet 124. The airflow leaves the air outlet 124 at the near section A and flows towards a far section C of the air outlet 124 through a middle section B.

Referring to FIG. 4 and following table 1, when the flow field of the airflow at the air outlet 124 is simulated by using computational fluid dynamics (CFD) software, it was found that the flux of the airflow at the near section A of the air outlet 124 occupies 53.9% of the total flux 2.84 cfm (cubic feet per minute) at the air outlet 124, which is more than the flux of the middle section B of the air outlet 124, which occupies 23.9% of the total flux, and far more than the flux of the far section C of the air outlet 124, which occupies 22.2% of the total flux. That is, the airflow non-uniformly flows through the air outlet 124.

TABLE 1

| Flux total (cfm) | Flux at section A (cfm) | Flux at section B (cfm) | Flux at section C (cfm) |
|---|---|---|---|
| 2.84<br>100% | 1.53<br>53.9% | 0.68<br>23.9% | 0.63<br>22.2% |

Since the airflow non-uniformly flows through the air outlet 124, heat convections between the airflow and fins at sections A, B and C of the air outlet 124 are different from each other. However, the fins at the middle section B and the far section C of the air outlet 124 have the same heat dissipation capabilities as the fins at the near section A of the air outlet 124. Thus, there is a room for improving the heat dissipation efficiencies of the fins at the middle section B and the far section C of the air outlet 124. Moreover, there will be loud noises generated by the airflow flowing though the near section A of the air outlet 124, which violates the quiet requirement for the cooling fan 10.

For the foregoing reasons, there is a need for a cooling fan which has low noise and has more optimized airflow distribution.

SUMMARY OF THE INVENTION

The present invention relates to a cooling fan which has low noise and has more optimized airflow distribution. The cooling fan includes a housing and an impeller. The housing includes a base, a sidewall extending from a periphery of the base with an air outlet defined therein, and a cap covering the sidewall. The impeller has a plurality of blades rotatably received in the housing for generating an airflow. An air channel is formed between tip portions of the blades and an inner face of the sidewall. The air outlet has a near section and a far section. The airflow first reaches the near section and then the far section. The base of the housing has a protrusion extending into the air outlet for guiding the airflow flowing towards the far section from the near section of the air outlet.

BRIEF DESCRIPTION OF THE DRAWINGS

Many aspects of the present cooling fan can be better understood with reference to the following drawings. The components in the drawings are not necessarily drawn to scale, the emphasis instead being placed upon clearly illustrating the principles of the present cooling fan. Moreover, in the drawings, like reference numerals designate corresponding parts throughout the several views.

DETAILED DESCRIPTION OF THE INVENTION

Figure 1:
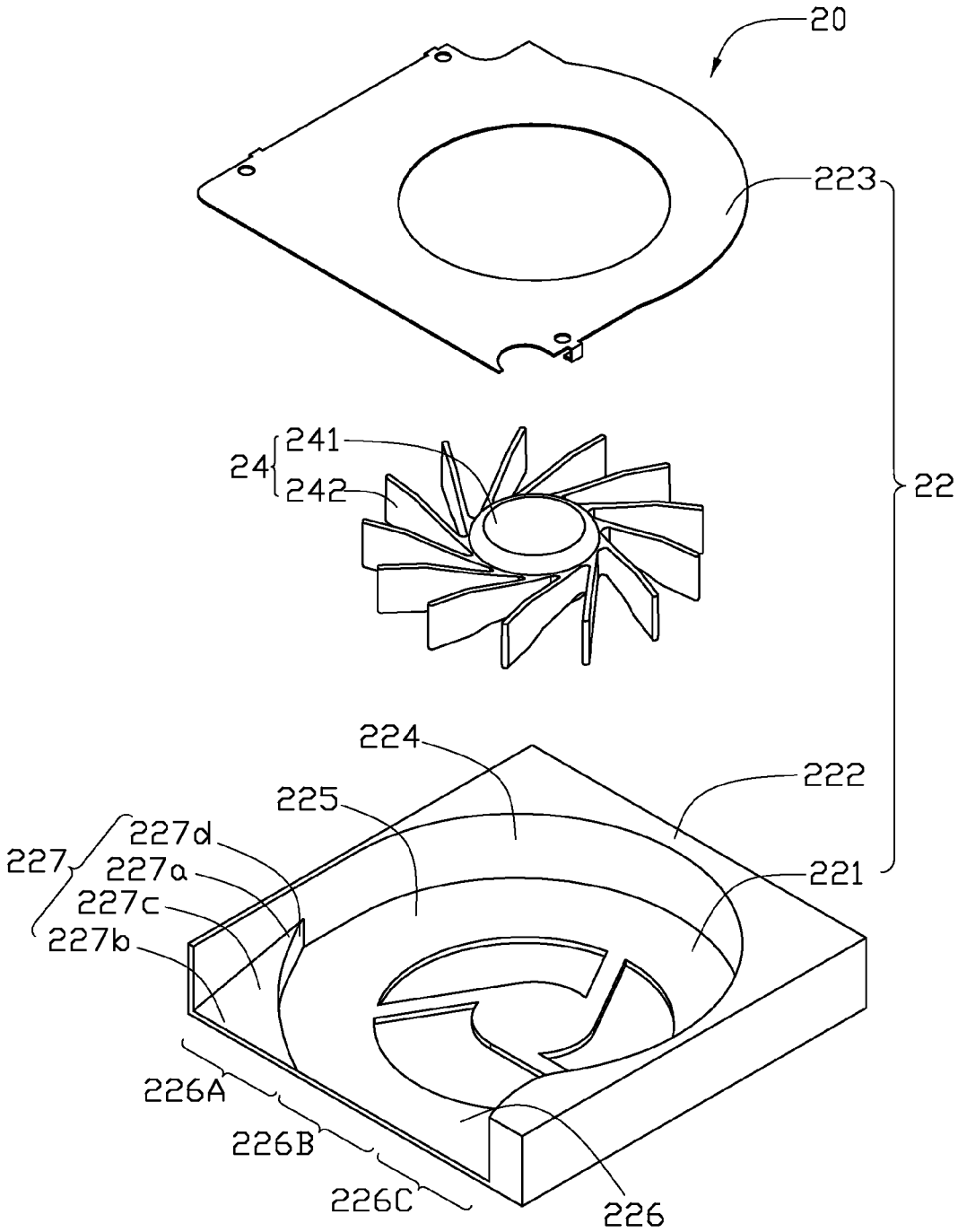
FIG. 1 is an exploded, isometric view of a cooling fan in accordance with a preferred embodiment of the present invention.

Referring to FIG. 1, a cooling fan 20 of a preferred embodiment of the present invention includes a housing 22 and an impeller 24 disposed in the housing 22. The impeller 24 includes a hub 241 and a plurality of blades 242 radially and outwardly extending from the hub 241.

The housing 22 includes a base 221, a sidewall 222 perpendicularly and upwardly extending from a periphery of the base 221, and a cap 223 covering the sidewall 222. A chamber 224 is defined between the base 221, the sidewall 222 and the cap 223, rotatably receiving the impeller 24 therein. In operation of the cooling fan 20, the impeller 24 drives an airflow flowing through an air channel 225 formed between tip portions of the blades 242 and an inner surface of the sidewall 222 and towards an air outlet 226 of the cooling fan 20. The air outlet 226 has a near section 226A, a middle section 226B and a far section 226C. The airflow first reaches the near section 226A and then through the middle section 226B towards the far section 226C. The base 221 of the housing 22 has a substantially triangular protrusion 227 extending upwardly from the base 221. The protrusion 227 is arranged at the near section 226A of the air outlet 226 and integrally formed with the sidewall 222 from a single piece. A height of the protrusion 227 gradually decreases outwardly from an inner portion 227*a*, which is adjacent to the chamber 224 of the housing 22, towards an outer portion 227*b*, which is adjacent to the air outlet 226. A width of the protrusion 227 gradually increases outwardly from the inner portion 227*a* towards the outer portion 227*b*. Preferably, a maximum height of the protrusion 227 occupies about a half of a height of the sidewall 222 of the housing 22. A slantwise guiding surface 227*c* is formed on a top surface of the protrusion 227, guiding the airflow to flow towards fins (not shown) disposed at the air outlet 226 of the cooling fan 20. An inner side surface 227*d* of the protrusion 227 is substantially arc-shaped such that distances between the inner side surface 227*d* of the protrusion 227 and the tip portions of the blades 242 are constant.

During operation of the cooling fan 20, the impeller 24 rotates in the chamber 224 and drives the airflow flows towards the near section 226A of the air outlet 226. When the airflow arrives at the air outlet 226, one part of the airflow flows out of the air outlet 226 via the guiding surface 227*c* of the protrusion 227, whilst the other part of the airflow is guided by the inner side surface 227*d* of the protrusion 227 and flows towards the middle section 226B and the far section 226C of the air outlet 226. Therefore, there is more airflow being guided towards the far section 226C of the air outlet 226 via the inner side surface 227*d* of the protrusion 227. The flux of the airflow at the air outlet 226 of the cooling fan 20 is optimally distributed more evenly.

Table 2 below shows the flux distribution of the airflow at the sections 226A, 226B and 226C of the air outlet 226 of the housing 22 of the present cooling fan 20. From table 2, when the present cooling fan 20 has substantially similar air channel 225, impeller 24 and rotation speed to the related cooling fan 10, the total flux of the airflow generated by the present cooling fan 20 is about 0.04 cfm (cubic feet per minute) less than the related cooling fan 10. However, the airflow distributed at the middle section 226B of the air outlet 226 of the present cooling fan 20 occupies about 26.7% of the total flux of the airflow of the air outlet 226, and the airflow distributed at the far section 226C of the air outlet 226 of the present cooling fan 20 occupies about 22.9% of the total flux of the airflow. In other words, the airflow flux at the section 226A of the present cooling fan 20 is decreased compared with the section A of the related cooling fan 10, whilst the airflow flux at each of the section 226B and the section 226C of the present cooling fan 20 is relatively increased compared with the corresponding section B (or C) of the related cooling fan 10. The occupation percentages of the airflow flux of the middle section 226B and of the far section 226C of the air outlet 226 of the present cooling fan 20 are greater than that of the middle section B and the far section C of the air outlet 124 of the related cooling fan 10. Therefore, the distribution of the airflow of the present cooling fan 20 is more evenly distributed than the related cooling fan 10.

TABLE 2

| Flux total (cfm) | Flux at section 226A (cfm) | Flux at section 226B (cfm) | Flux at section 226C (cfm) |
|---|---|---|---|
| 2.80<br>100% | 1.41<br>50.4% | 0.75<br>26.7% | 0.64<br>22.9% |

Figure 2:
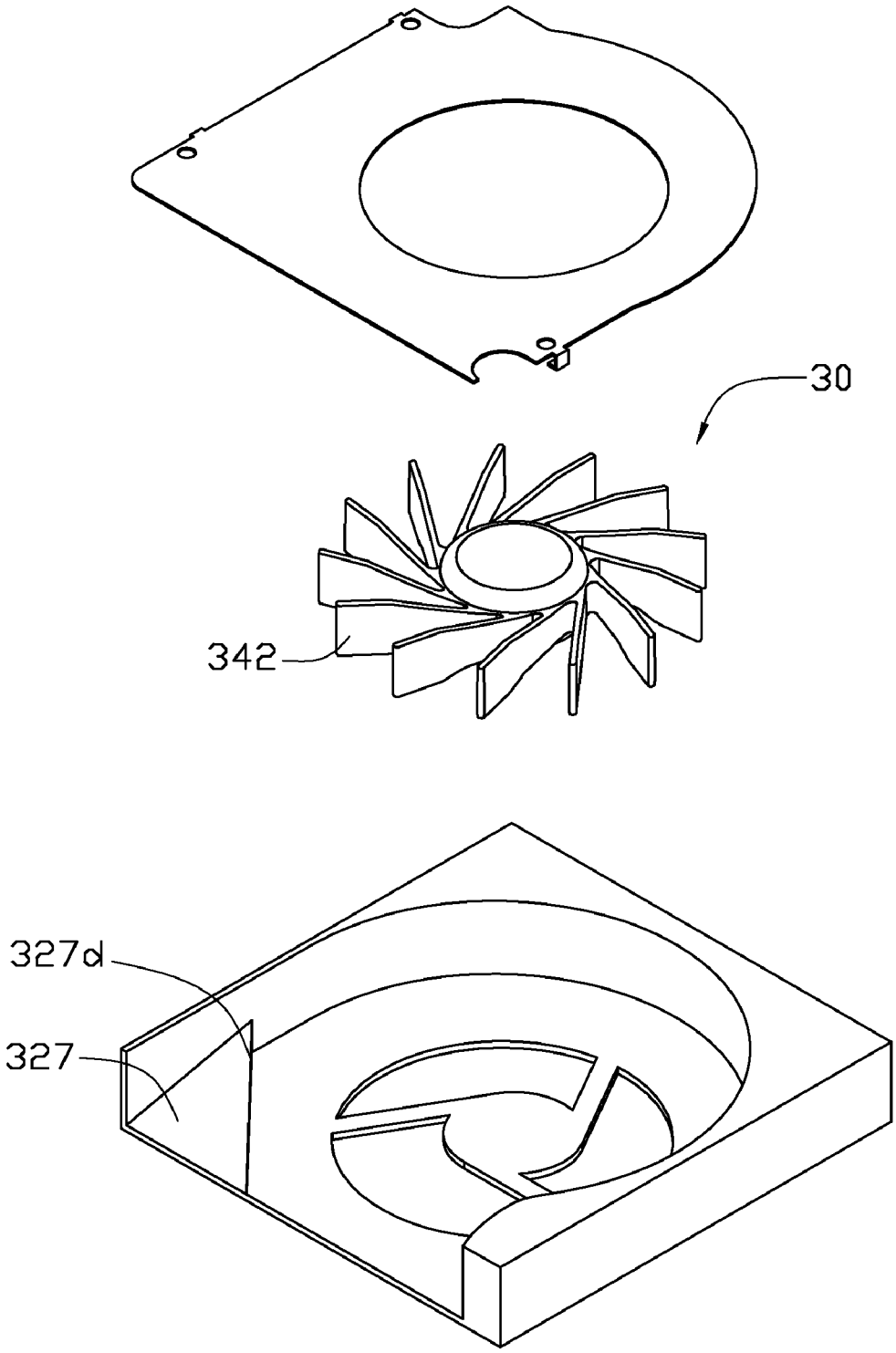
FIG. 2 is an exploded, isometric view of a cooling fan in accordance with a second embodiment of the present invention.
Figure 3:
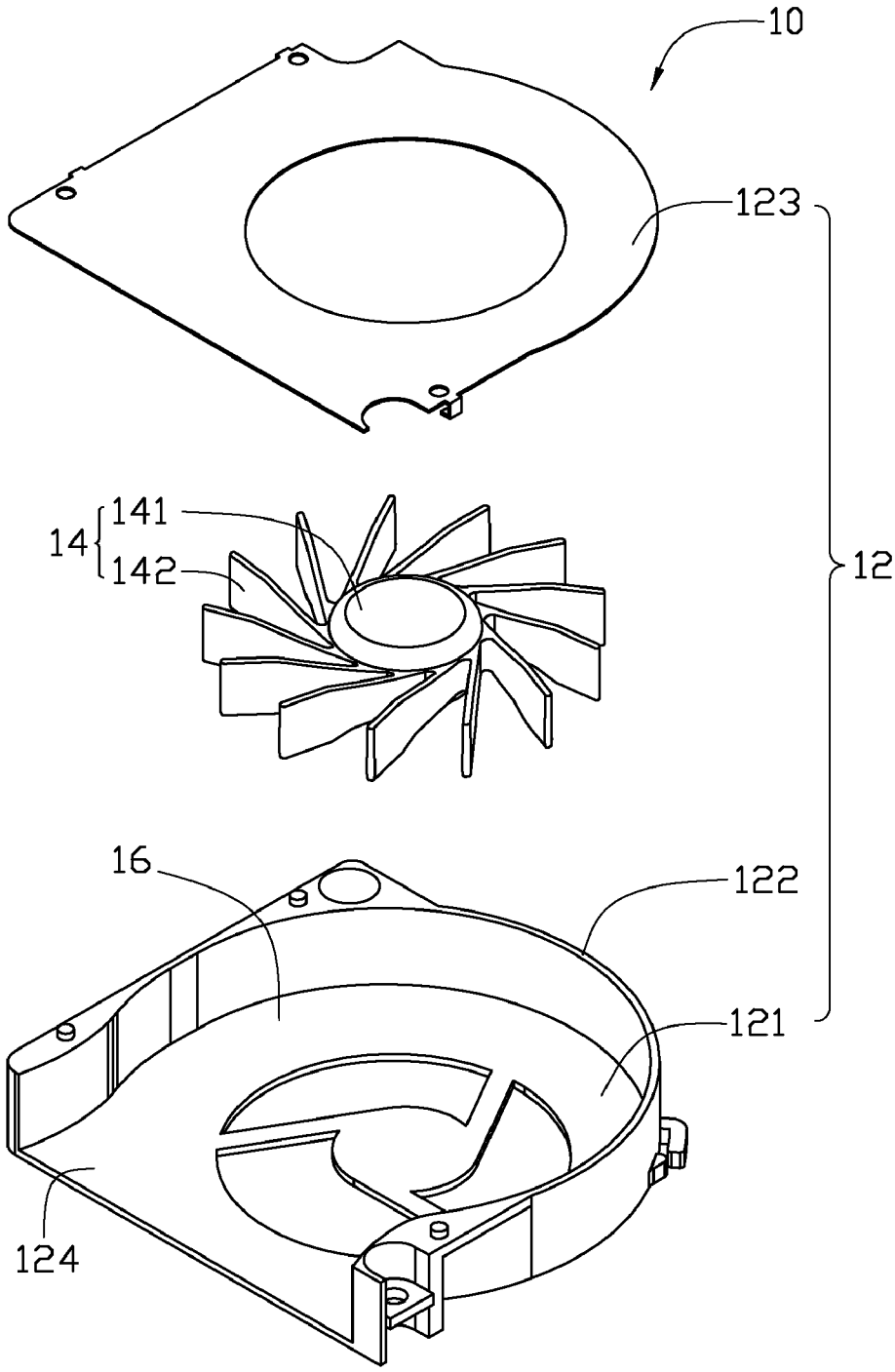
FIG. 3 (RELATED ART)
FIG. 3 is an exploded, isometric view of a cooling fan in related art.
Figure 4:
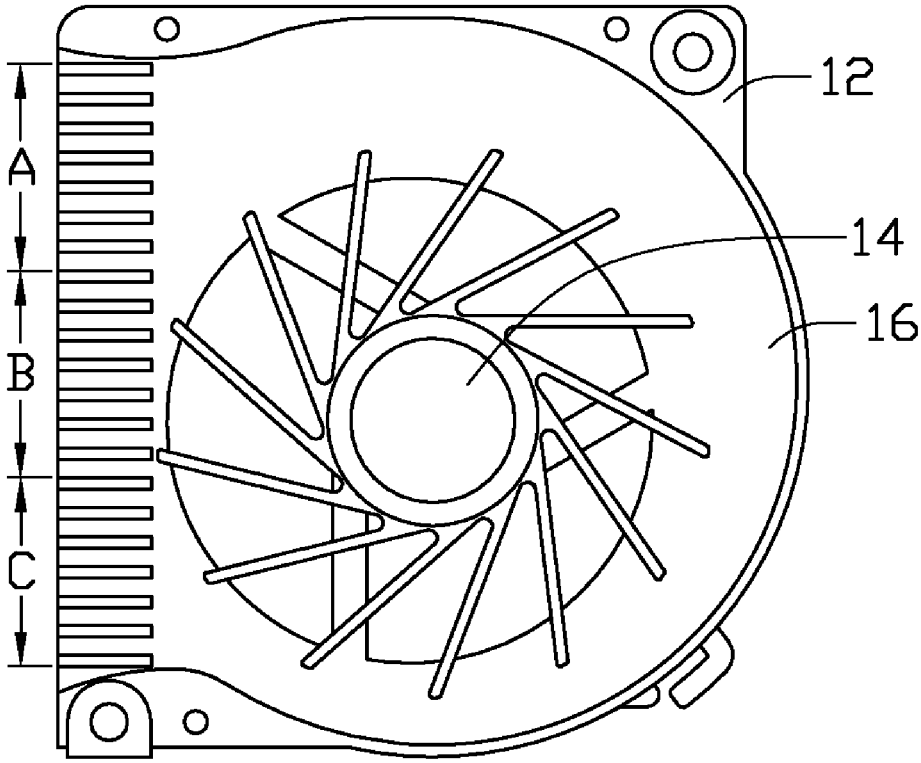
FIG. 4 (RELATED ART)
FIG. 4 is a top view of the cooling fan of FIG. 3, with a cap being removed and a plurality of fins being arranged at an air outlet of the cooling fan.

Referring to FIG. 2, a second embodiment of the present cooling fan 30 is shown. The difference between the first preferred embodiment and the second embodiment is: the inner side surface 327*d* of the protrusion 327 is linear-shaped and distances between the inner side surface 327*d* of the protrusion 327 and the tip portions of the blades 342 are variable.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A cooling fan comprising:

an impeller having a plurality of blades; and a housing having a base, a sidewall extending from a periphery of the base with an air outlet defined therein, and a cap covering the sidewall;

a chamber formed between the cap, the base and the sidewall, the impeller being rotatably received in the chamber and configured for generating an airflow; and an air channel formed between tip portions of the blades and an inner face of the sidewall, the air outlet having a near section and a far section, the airflow first reaching the near section and then the far section;

wherein the base of the housing has a protrusion extending into the air outlet, the protrusion is disposed at the near section of the air outlet and configured for guiding the airflow flowing towards the far section from the near section of the air outlet, and a maximum height of the protrusion occupies substantially a half of a height of the sidewall of the housing.

2. The cooling fan as described in claim 1, wherein the protrusion has an inner portion adjacent to the chamber and an outer portion adjacent to the air outlet, the protrusion having a width gradually increased outwardly from the inner portion towards the outer portion.

3. The cooling fan as described in claim 1, wherein the protrusion has an inner portion adjacent to the chamber and an outer portion adjacent to the air outlet, a height of the protrusion being gradually decreased outwardly from the inner portion towards the outer portion.

4. The cooling fan as described in claim 3, wherein an inner side surface of the protrusion is arc-shaped.

5. The cooling fan as described in claim 4, wherein distances between the inner side surface of the protrusion and the tip portions of the blades are constant.

6. The cooling fan as described in claim 3, wherein an inner side surface of the protrusion is linear shaped.

7. A cooling fan comprising:

a housing comprising a chamber, an air outlet communicated with the chamber, a protrusion formed on the housing and protruded into the air outlet, the protrusion having an inner portion adjacent to the chamber and an outer portion adjacent to the air outlet, a height of the protrusion being gradually decreased outwardly from the inner portion towards the outer portion, and a maximum height of the protrusion occupying substantially a half of a height of the chamber; and an impeller having a plurality of blades disposed in the chamber.

8. The cooling fan as described in claim 7, wherein the air outlet has a near section and a far section, a flux of the airflow at the near section being greater than the far section, the protrusion being arranged at the near section of the air outlet.

9. The cooling fan as described in claim 7, wherein the housing includes a base, a sidewall extending from the base and a cap covering the sidewall, the chamber is formed between the cap, the base and the sidewall, and the maximum height of the protrusion occupies substantially a half of a height of the sidewall of the housing.

10. The cooling fan as described in claim 7, wherein an inner side surface of the protrusion is arc-shaped.

11. The cooling fan as described in claim 10, wherein distances between the inner side surface of the protrusion and tip portions of the blades are constant.

12. The cooling fan as described in claim 7, wherein an inner side surface of the protrusion is linear shaped.

13. The cooling fan as described in claim 7, wherein the protrusion extends upwardly from a base of the housing and abuts on an inner surface of a sidewall of the housing.

14. The cooling fan as described in claim 7, wherein the protrusion has a width gradually increased outwardly from the inner portion towards the outer portion.

15. The cooling fan as described in claim 14, wherein the air outlet further includes a middle section between the near section and the far section, each of the three sections occupying one third of a total width of the air outlet, the protrusion having a maximum width equal to the near section.

16. The cooling fan as described in claim 14, wherein an inner side surface of the protrusion is arc-shaped.

17. The cooling fan as described in claim 14, wherein an inner side surface of the protrusion is linear shaped.

* * * * *